US005551631A

United States Patent [19]

Cailliau

[11] Patent Number: 5,551,631

[45] Date of Patent: Sep. 3, 1996

[54] RAIL SUPPORT DEVICE FOR UNBALLASTED RAILWAY TRACK

[75] Inventor: Joël Cailliau, Faches Thumesnil, France

[73] Assignee: Allevard, Saint Cloud Cedex, France

[21] Appl. No.: 367,316

[22] PCT Filed: Jul. 20, 1993

[86] PCT No.: PCT/FR93/00706

§ 371 Date: Jan. 20, 1995

§ 102(e) Date: Jan. 20, 1995

[87] PCT Pub. No.: WO94/02685

PCT Pub. Date: Feb. 3, 1994

[30] Foreign Application Priority Data

Jul. 20, 1992 [FR] France ..... 92 08946

[51] Int. Cl.[6] ..... E01B 1/00

[52] U.S. Cl. ..... 238/115; 238/109; 238/382

[58] Field of Search ..... 238/109, 110, 238/111, 115, 116, 117, 119, 120, 382

[56] References Cited

U.S. PATENT DOCUMENTS 1,033,032 7/1912 Morel ..... 238/116
3,289,941 12/1966 Sonneville ..... 238/116
3,313,486 4/1967 Sonneville ..... 238/117
3,550,850 12/1970 Sonneville ..... 238/115

FOREIGN PATENT DOCUMENTS 2410086 7/1979 France ..... 238/115
1419565 12/1975 United Kingdom ..... 238/115

*Primary Examiner*—Mark T. Le
*Attorney, Agent, or Firm*—Dennison, Meserole, Pollack & Scheiner

[57] ABSTRACT

Rail support device for unballasted railway track comprising at least one concrete block resting on a flexible base, the assembly being held in an elastomeric shell which is anchored in a bed or mortar covering the lower part of said block, and which has a beading around its top edge. The horizontal cross section of said block is variable and has a maximum area at the level immediately below the beading on the upper edge of the shell so as to limit the relative movement of the block and the shell by means of an elastic force.

8 Claims, 2 Drawing Sheets

RAIL SUPPORT DEVICE FOR UNBALLASTED RAILWAY TRACK

BACKGROUND OF THE INVENTION

In the majority of railway networks, the railway is constituted by rails fixed on ties, or sleepers, placed perpendicularly to the rail, said ties resting on a thickness of stones called ballast. This traditional design of the track has been very successful and has proved perfectly adaptable to varied types of rail traffic.

However, cases exist where another railway technique is preferred to this traditional track, in particular when the supply, transport or maintenance of the ballast and of the track proves problematic: this is the case in particular in a zone of difficult access, such as in a tunnel. In that case, a so-called unballasted track is used, whose bed is made of concrete which replaces the bed of stones.

A particularly wide-spread embodiment of unballasted track comprises, as shown in FIG. 1, a cross-tie constituted by two blocks of concrete or tie-pieces, connected together by an angle piece called brace. The shape of the lower part of the concrete blocks is designed so as to perfectly match the shape of an enveloping shell made of elastomer and called "slipper".

Between the lower face of the concrete block and the bottom of the envelope is generally disposed an elastomer sole whose surface is substantially equal to the surface of the lower face of the block. This sole presents a suppleness adapted to the nature of the traffic on the line and gives the track an elasticity in the vertical direction which replaces or improves the elasticity provided by the conventional ballast.

The lateral walls of the envelope are provided with relief elements of the groove type which ensure a certain elasticity in the horizontal plane. In the upper part of the envelope, a bead, disposed over the whole contour, allows a correct hold of the envelope on the blocks of concrete, avoiding excessive gaping.

This bead, combined with a particular geometry of the blocks of concrete, limits the possible introduction of water between the envelope and the block.

When the track is laid, the assembly constituted by the rails and ties joined together by a fastening system, is positioned with the aid of wedging devices and a so-called wedging mortar is poured, which fixes the track in a geometrical position determined once and for all. The mortar is poured up to a height slightly lower than the level of the lower edge of the bead of the shell; the lower part of the envelope is then surrounded with mortar, forming a housing in honeycomb form.

This type of unballasted track is mainly used for applications in tunnels, for underground networks or for conventional lines of railway networks where the trains circulate at speeds below the high-speed domain of which the lower threshold may be situated at approximately 200 km/hr.

High-speed tracks pose, in fact, a particular problem which resides in the fact that the dynamic movements of the rail and of the tie upon passage of the convoys are substantially greater than on a track intended for circulation at normal speed; now, with reference to FIG. 1, it appears that nothing limits the upward displacement of the rail and tie except the gravity exerted on these elements. It follows that a lifting of the blocks and the rail generated by track deformation waves cannot be excluded.

Such lifting may prove critical if its amplitude is such that a clearance may occur between the block and the sole or between the sole and the bottom of the envelope; in that case, a shock may result during the descending movement of the block when the clearance is cancelled.

SUMMARY OF THE INVENTION

It is an object of the present invention to provide a solution to this problem which, at the present time, has not yet been solved. To that end, particular devices have been designed so as elastically to fix the tie in the vertical direction by exerting a downward return force when the tie tends to lift. This elastic linkage completes the elastic linkage provided by the sole to form a bilateral elastic linkage.

This object is attained by means of a device for supporting a railway rail on a track without ballast, comprising at least one concrete block resting on a supple sole; the assembly being maintained in a shell made of elastomer material anchored in a bed of concrete which envelops the lower part of said block and of which the upper edge is provided with a bead, characterized in that the horizontal section of said block is variable and presents a maximum surface at a level located immediately beneath the bead of the upper edge of the envelope so as to limit the relative displacement of the block and of the envelope by elastic retention.

According to an embodiment of the invention, the horizontal section of said block is variable by modifying its width.

According to an advantageous characteristic of the invention, the thickness of the bead is variable along the upper edge of said envelope.

According to another characteristic, the inner lateral walls of the envelope are provided with horizontal grooves adapted to cooperate with corresponding grooves made on the lateral face of the lower part of said block.

According to yet another characteristic, said bead further comprises a member for clamping on the upper part of said block.

According to a variant embodiment, the outer lateral walls of said envelope are provided with peripheral projections to reinforce anchoring in the bed of mortar.

BRIEF DESCRIPTION OF THE DRAWINGS

The invention will be more readily understood on reading the following description with reference to the accompanying drawings, in which.

DESCRIPTION OF THE PREFERRED EMBODIMENTS

Figure 1A:
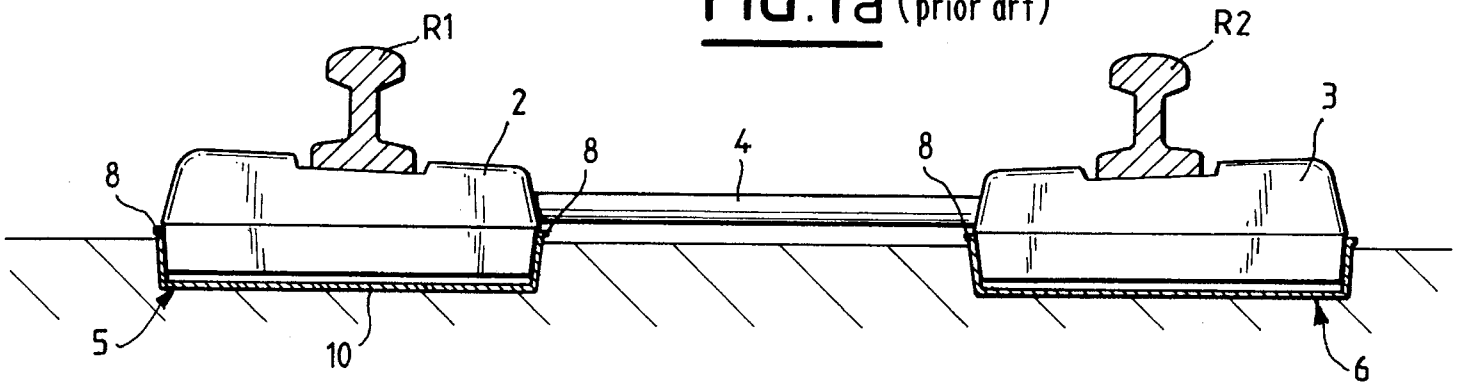
FIG. 1a (prior art)
FIGS. 1*a* and 1*b* show a conventional embodiment of a device for supporting a rail on a track without ballast, in side view and plan view, respectively.
Figure 1B:
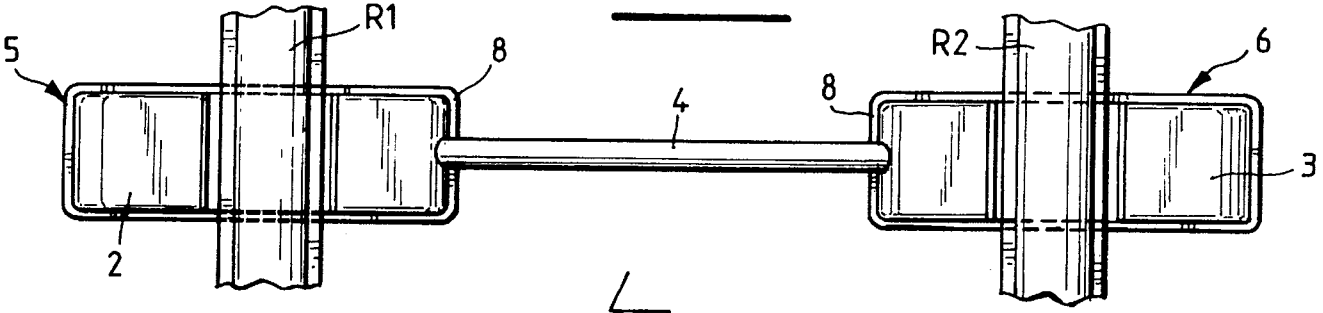
FIG. 1b (prior art)

The conventional device for supporting rails, shown in FIGS. 1*a* and 1*b*, comprises a tie constituted by two blocks of concrete or tie pieces 2, 3, disposed symmetrically and possibly connected by an angle piece or brace 4 and on which rails R1 and R2 rest.

The blocks 2, 3 rest on a supple sole 10 and the block/sole assembly is placed in a shell 5, 6 make of elastomer material which envelops the lower part of said block and of which the upper edge is provided with a bead 8.

The shell 5, 6 is anchored and embedded up to the level of the bead 8 in a bed of mortar B.

Figure 2:
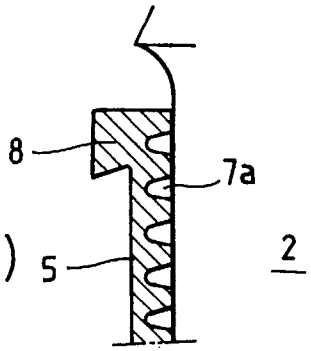
FIG. 2 (prior art)
FIG. 2 shows a view in detail, in section, of a conventional enveloping shell.
Figure 5:
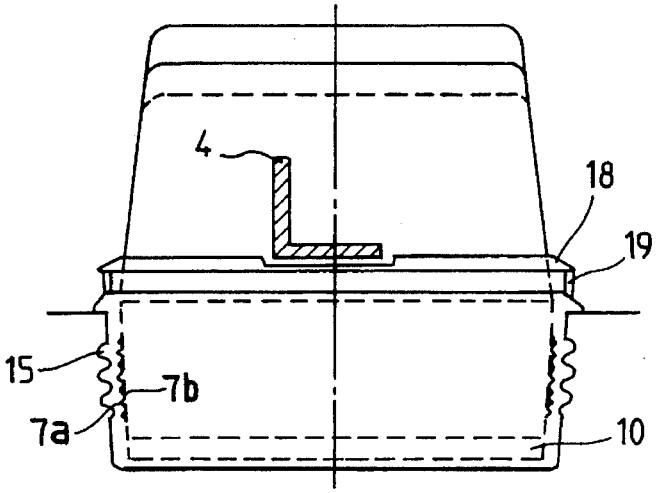
FIG. 5 shows a side view in section of the device of the invention.

FIG. 2 shows a view in detail, in section, of the assembly constituted by the block 2 and the shell 5 shown in FIGS. 1*a*, 1*b*. The inner face of the lateral wall of the shell 5 is advantageously provided with grooves or cavities 7*a* adapted to cooperate with corresponding grooves 7*b* in FIG. 5, made on the lateral face of the lower part of the block to reinforce holding of said block 2 by suction effect and to ensure a certain elasticity in the horizontal plane.

Figure 3A:
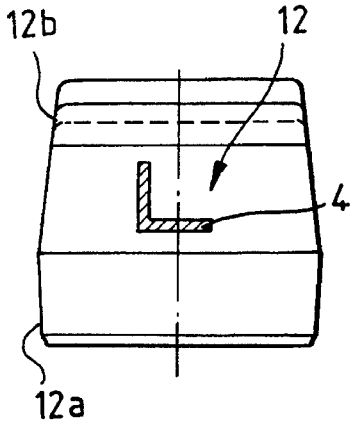
FIGS. 3*a* and 3*b* respectively show a side view and a plan view of an embodiment of the concrete block used in the device of the invention.
Figure 3B:
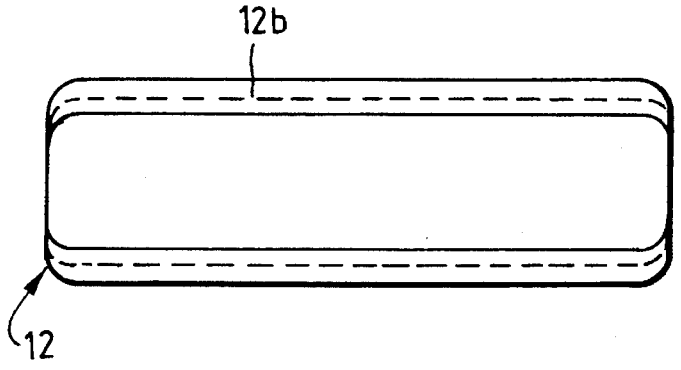

FIGS. 3*a* and 3*b* show an embodiment of a concrete block used in the device of the invention.

In these Figures, block 12 has a geometry different from blocks 2 and 3 described hereinbefore. Starting from the base and upwardly, the horizontal section of the block has a variable surface which firstly increases to attain a maximum located at a level which lies immediately below the bead of the upper edge of the envelope so as to limit the relative displacement of the block and envelope by elastic retention.

In other words, the envelope 15 presents a height such that, once the block is in place therein, the upper edge of the envelope lies above the contour where the surface of the horizontal section of the concrete is maximum but the width of the empty envelope is such that it is then necessary elastically to deform its upper edge in order to pass it above the level where the width of the block is maximum.

In FIGS. 3*a* and 3*b*, this characteristic is obtained by making the block with a variable width; the lower part 12*a* presenting divergent lateral faces while the upper part 12*b* presents convergent lateral faces.

In this way, the shell 15 firmly and tightly envelops the block 12 by retention of the bead 18 above the divergent lateral faces.

The bead 18 advantageously comprises a clamping member, for example a strap 19, which applies the bead 18 on the walls of the block 12. Such application will be all the more efficient as the thickness of the bead will be variable along the upper edge of the shell to obtain a suitable distribution of pressure on the contour.

Figure 4:
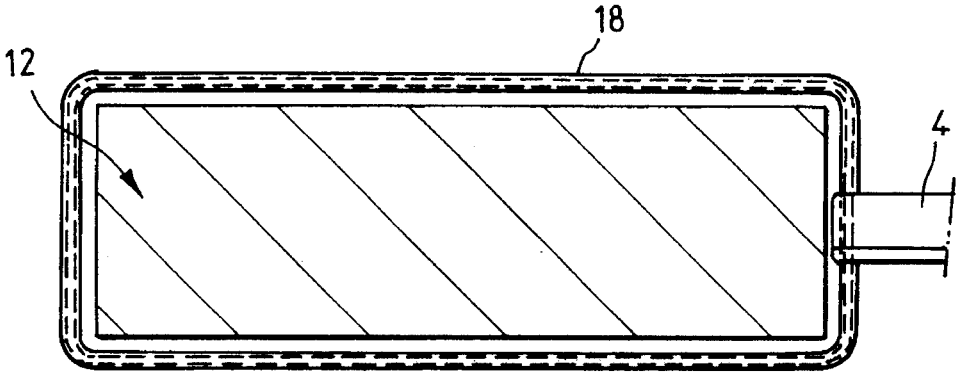
FIG. 4 shows a plan view of the device of the invention.

FIG. 4 shows in plan view a section of the shell in a horizontal plane located at the height of the bead.

According to another embodiment of the invention, the clamping device may be incorporated in the envelope during molding thereof and will therefore act inside the material in the manner of a spring. An elastic clamping member (cord . . .) may also be provided, housed in an inner conduit made in said bead 18. It clearly appears that, with this device, block and enveloping shell become fast as soon as the clamping device is in place.

In fact, the clamping device tightens the block at a spot where its section in a horizontal plane decreases, which consequently blocks any relative upward displacement between block and envelope.

It will further be noted that, due to the tightening effort, the seal between the envelope and block is very considerably improved because of the contact pressure of the bead which is exerted on all the periphery of the envelope.

In order to control the movement of the block with respect to an absolute reference, the lateral walls of the lower part of the shell are provided with peripheral projections 15*a*.

These projections have a geometry suitable for reinforcing the hold of the anchoring of the envelope in the concrete and for avoiding a possible detachment of the block/envelope assembly with respect to the honeycomb-shaped housing in the concrete: the Figure illustrates the catching zone of the envelope in the concrete.

What is claimed is:

1. Device supporting a railway rail on an unballasted track, comprising:

a) a concrete block on which the rail is to rest;

b) a supple sole located below the concrete block, on which the block rests; and c) an elastomeric shell for anchoring in a bed of mortar and paid shell envelops the supple sole and a lower part of said concrete block, said shell having an upper edge provided with a bead, said block having a horizontal cross-section which varies and presents a maximum area at a vertical level just below the bead and remote from the sole so as to limit relative displacement of the block and the envelope by elastic retention.

2. Device according to claim 1, wherein said block has a width which varies in order to vary said horizontal cross-section.

3. Device according to claim 1, wherein said bead has a thickness which varies along said upper edge.

4. Device according to claim 1, wherein vertical inner lateral walls of said envelope and vertical lateral faces of said block are provided with corresponding and cooperating horizontal grooves.

5. Device according to claim 1, wherein said bead further comprises a member for clamping on an upper portion of said block.

6. Device according to claim 1, wherein outer vertical lateral walls of said envelope are provided with peripheral projections to reinforce anchoring in the bed of mortar.

7. Device supporting a railway rail on an unballasted track, comprising:

a) first and second concrete blocks on which rails are to rest;

b) a supple sole located below each concrete block, on which the block rests;

c) a pair of elastomeric shells for anchoring in a bed of mortar, each shell enveloping a supple sole and a lower part of a concrete block, each shell having an upper edge provided with a bead; and d) brace means connecting together upper parts of said first and second concrete blocks above the level of said beads, said blocks having a horizontal cross-sections which vary and present a maximum area at a vertical level just below the beads and remote from the soles, so as to limit relative displacement of the blocks and the envelopes by elastic retention.

8. Device supporting a railway rail on an unballasted track, comprising:

a) a concrete block on which the rail is to rest;

b) a supple sole located below the concrete block, on which the block rests;

c) an elastomeric shell which envelops the supple sole and a lower part of said concrete block, said shell having an upper edge provided with a bead; and d) a bed of mortar in which the shell is anchored, said block having a horizontal cross-section which varies and presents a maximum area at a vertical level just below the bead and remote from the soles, so as to limit relative displacement of the block and the envelope by elastic retention.

* * * * *